US005327665A

United States Patent [19]

Manning et al.

[11] Patent Number: 5,327,665

[45] Date of Patent: Jul. 12, 1994

[54] ADJUSTABLE QUILTING HOOP APPARATUS

[76] Inventors: Paul Manning; Bernice E. Manning, both of 5607 Warren Ave., Norwood, Ohio 45212

[21] Appl. No.: 27,432

[22] Filed: Mar. 8, 1993

[51] Int. Cl.[5] ..... D05C 01/02

[52] U.S. Cl. ..... 38/102.2; 248/122; 108/6

[58] Field of Search ..... 38/102, 102.1-102.4, 38/102.5, 102.8, 102.91; 248/441.1, 450, 452, 453, 121, 122, 126, 127; 108/1, 4, 6, 10

[56] References Cited

U.S. PATENT DOCUMENTS

| | | | |
|---|---|---|---|
| 437,240 | 9/1890 | Przewdzink | 38/102.2 |
| 699,263 | 5/1902 | Vosler | 38/102.2 |
| 706,176 | 8/1902 | Hassett | 248/122 |
| 1,357,737 | 11/1920 | Solani | 38/102.2 |
| 3,309,803 | 3/1967 | Wilson | 38/102.2 |
| 3,774,325 | 11/1973 | Johnson et al. | 38/102.2 |
| 3,855,718 | 12/1974 | Parsons et al. | 38/102.2 |
| 4,658,521 | 4/1987 | Thorpe | 38/102.6 |
| 5,074,513 | 12/1991 | Presley et al. | 248/454 |
| 5,080,315 | 1/1992 | Tucker-Schafer | 248/441.1 |
| 5,119,572 | 6/1992 | Graham | 38/102.2 |

*Primary Examiner*—Clifford D. Crowder
*Assistant Examiner*—Ismael Izaguirre
*Attorney, Agent, or Firm*—E. Michael Combs

[57] ABSTRACT

An apparatus to position a quilting hoop organization relative to an individual's lap includes a base plate having telescoping first and second tubes extending from the base plate in an orthogonal relationship, with the second tube mounting positioning tubes in a manner to pivotally position the quilting hoops in a desired angulation relative to an individual's lap. The apparatus is arranged for ease of disassembly for transport and storage.

2 Claims, 4 Drawing Sheets

ADJUSTABLE QUILTING HOOP APPARATUS

BACKGROUND OF THE INVENTION

1. Field of the Invention

The field of invention relates to quilting apparatus, and more particularly pertains to a new and improved quilting hoop apparatus wherein the same is arranged to permit positioning and orientation of a quilting hoop relative to an individual's lap, while simultaneously positioning the quilting hoop in a stable relationship relative to an underlying floor support surface.

2. Description of the Prior Art

Quilting frame structure of various types have been utilized throughout the prior art wherein U.S. Pat. No. 4,658,521 indicates a frame structure including a rectilinear plurality of legs arranged with slots for positioning the legs in a spaced relationship relative to one another.

U.S. Pat. No. 4,422,251 to Hedrick sets forth a further example of quilting hoop structure.

The instant invention attempts to overcome deficiencies of the prior art by providing for a quilting hoop arranged for orienting the quilting hoop in a pivotal relationship relative to an individual's lap while mounting the quilting hoop structure firmly to an underlying support surface and in this respect, the present invention substantially fulfills this need.

SUMMARY OF THE INVENTION

In view of the foregoing disadvantages inherent in the known types of quilting hoop apparatus now present in the prior art, the present invention provides a quilting hoop apparatus wherein the same is arranged for pivotal positioning of a quilting hoop relative to an underlying support structure. As such, the general purpose of the present invention, which will be described subsequently in greater detail, is to provide a new and improved quilting hoop apparatus which has all the advantages of the prior art quilting hoop apparatus and none of the disadvantages.

To attain this, the present invention provides a structure to position a quilting hoop organization relative to an individual's lap including a base plate having telescoping first and second tubes extending from the base plate in an orthogonal relationship, with the second tube mounting positioning tubes in a manner to pivotally position the quilting hoops in a desired angulation relative to an individual's lap. The organization is arranged for ease of disassembly for transport and storage.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the prior art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of application, which is measured by the claims, nor is it intended to be limiting as to the scope of the invention in any way.

It is therefore an object of the present invention to provide a new and improved quilting hoop apparatus which has all the advantages of the prior quilting hoop apparatus and none of the disadvantages.

It is another object of the present invention to provide a new and improved quilting hoop apparatus which may be easily and efficiently manufactured and marketed.

It is a further object of the present invention to provide a new and improved quilting hoop apparatus which is of a durable and reliable construction.

An even further object of the present invention is to provide a new and improved quilting hoop apparatus which is susceptible of a low cost of manufacture with regard to both materials and labor, and which accordingly is then susceptible of low prices of sale to the consuming public, thereby making such quilting hoop apparatus economically available to the buying public.

Still yet another object of the present invention is to provide a new and improved quilting hoop apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
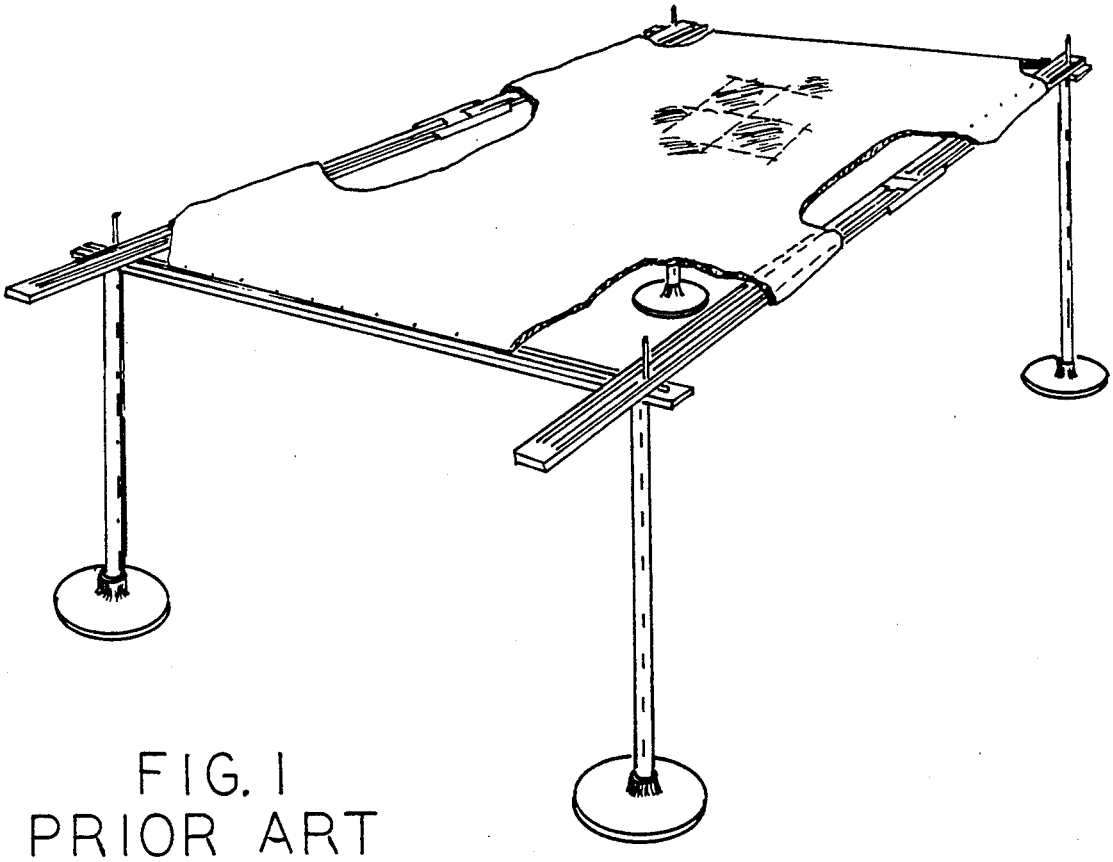
FIG. 1 PRIOR ART
FIG. 1 is an isometric illustration of a prior art quilting frame structure, as indicated in U.S. Pat. No. 4,658,521.
Figure 2:
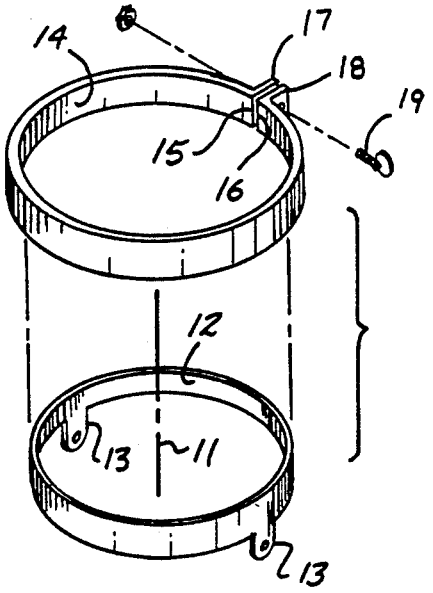
FIG. 2 is an isometric illustration of the inner and outer hoop structure of the apparatus.
Figure 3:
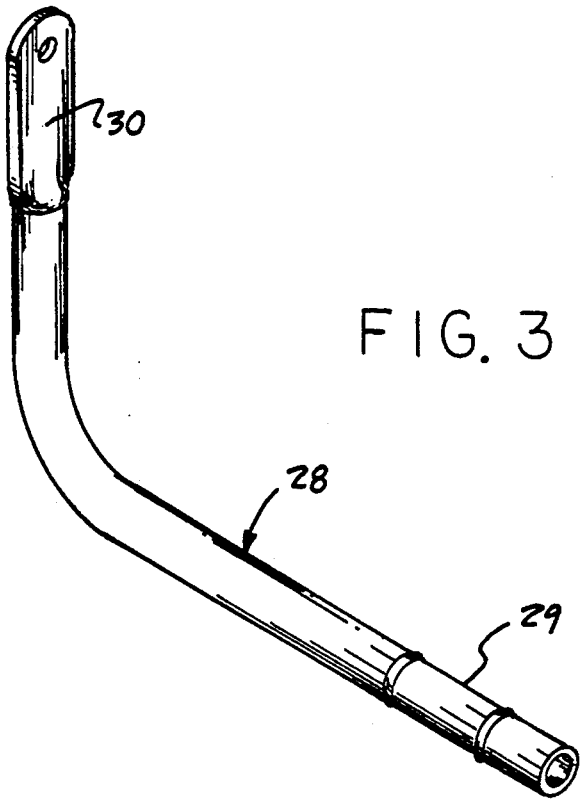
FIG. 3 is an isometric illustration of a positioning tube structure employed by the invention.
Figure 4:
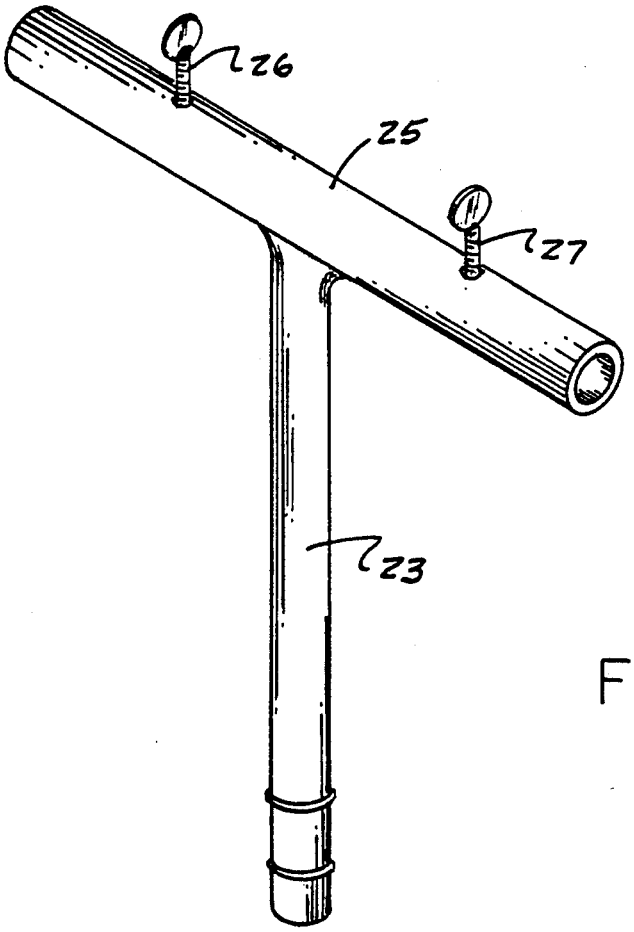
FIG. 4 is an isometric illustration of the support and mounting tube structure employed by the invention.
Figure 6:
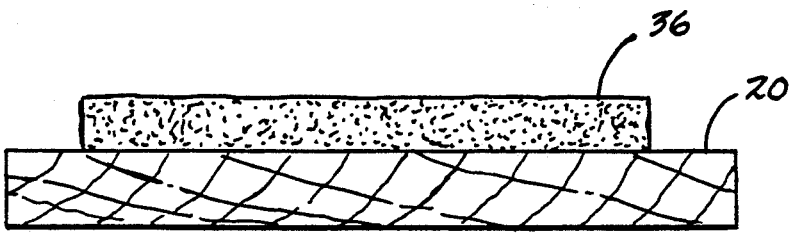
FIG. 6 is an orthographic view, taken along the lines 6—6 of FIG. 5 in the direction indicated by the arrows.
Figure 5:
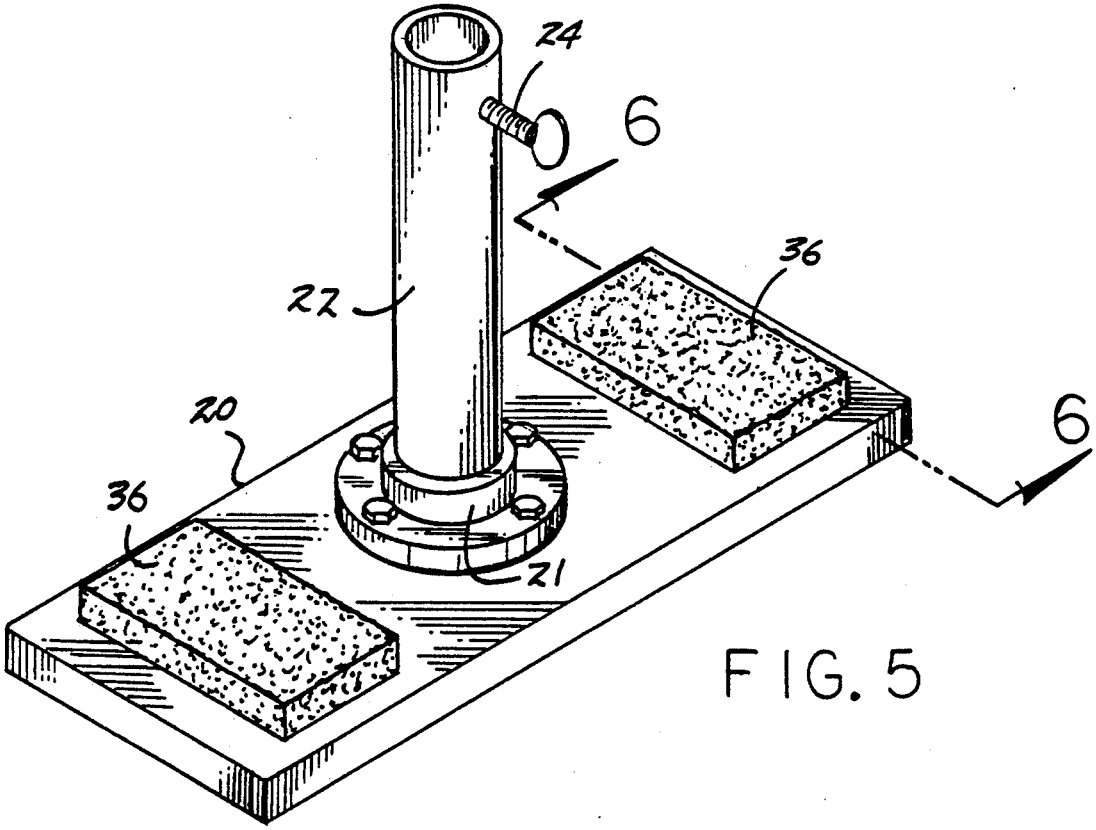
FIG. 5 is an isometric illustration of the base plate structure employed by the invention.

With reference now to the drawings, and in particular to FIGS. 1 to 8 thereof, a new and improved quilting hoop apparatus embodying the principles and concepts of the present invention and generally designated by the reference numeral 10 will be described.

More specifically, the quilting hoop apparatus 10 of the instant invention essentially comprises an inner hoop 12, as indicated of a cylindrical configuration, arranged for positioning interiorly and in a concentric relationship relative to a discontinuous outer hoop 14. The inner hoop 12 includes inner hoop flanges 13 extending in a parallel relationship relative to an axis 11 that is oriented concentrically of the inner and outer hoops. The inner hoop flanges 13 are arranged in a parallel coextensive relationship relative to one another for pivotal mounting relative to an underlying positioning tube structure, as indicated in the FIG. 7. The outer hoop 14 includes first and second ends 15 and 16 that are arranged in a facing relationship, having respective first and second end flanges 17 and 18 projecting exteriorly of the outer hoop, to include a hoop fastener 19 directed through the first and second flanges 17 and 18 to secure the first and second flanges together to thereby secure a quilting article that is oriented and positioned between the inner and outer hoops in use.

A base plate 20 is provided (see FIG. 7) having a support tube socket 21 positioned fixedly and medially of a top surface of the base plate, with a first support tube 22 received within the socket and a second support tube 23 telescopingly received within the first support tube 22 in a coaxially aligned relationship relative to the first support tube and the support tube socket 21. A first tube fastener 24 secures the second tube 23 relative to the first tube 22, as the first tube fastener 24 is directed threadedly through the first support tube 22 to engage the second support tube 23. A mounting tube 25 is oriented in a fixed orthogonal relationship medially intersected by the second support tube 23, wherein the mounting tube 25 includes respective mounting tube first and second fasteners 26 and 27 threadedly directed into the mounting tube 25 on opposed sides of its intersection with the second support tube 23. Respective first and second L-shaped positioning tubes 28 and 29 are provided, with the first L-shaped positioning tube 28 having a first positioning tube first end portion and a first positioning tube second end portion 29 and 30 respectively. The first positioning tube first end portion 29 is received within the mounting tube 25 and engaged by the mounting tube first fastener 26. The second positioning tube 32 includes second positioning tube first and second ends 33 and 34 respectively, with the second positioning tube 32 first end 33 received within the mounting tube 25 and engaged by the mounting tube second fastener 27. In this manner, the first and second mounting tube second end portions 30 and 34 are arranged in a parallel coextensive relationship, with the first and second positioning tube second ends 30 and 34 having orthogonally directed therethrough respective first and second axles 31 and 35. The first and second axles 31 and 35 are further received rotatably through one of the inner hoop flanges 13 in an orthogonal relationship permitting tilting of the inner hoop between the first and second positioning tubes 28 and 32.

Figures 7, 8:
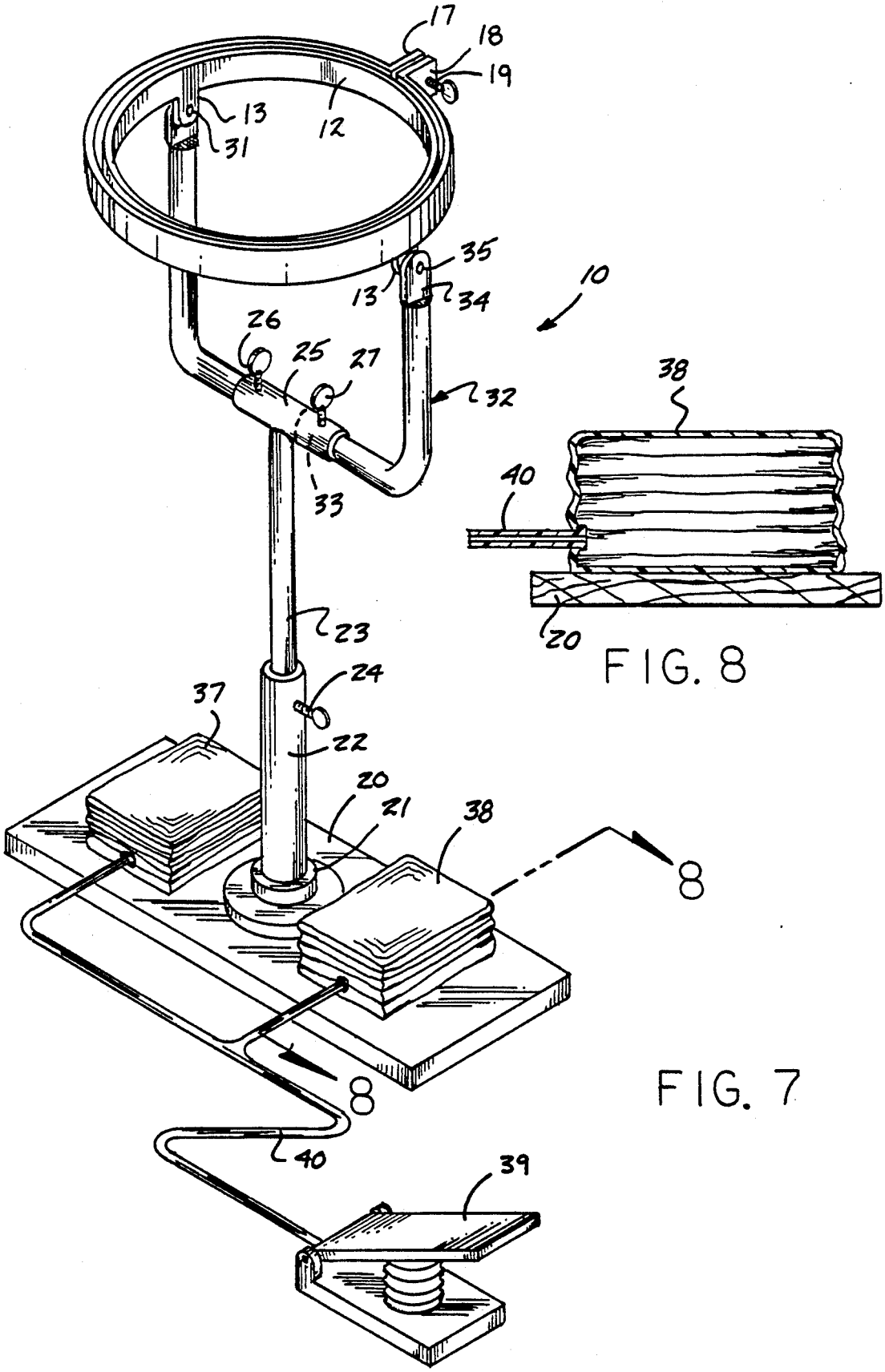
FIG. 7 is an isometric illustration of the invention.
FIG. 8 is an orthographic view, taken along the lines 8—8 FIG. 7 in the direction indicated by the arrows.

If required, resilient support pads 36 (see FIG. 5) are positioned in a fixed relationship relative to the top surface of the base plate 20 on opposed sides of the support tube socket 21. Alternatively, as indicated in FIG. 7, respective first and second pneumatic bladders 37 and 38 are mounted to the base plate top surface on opposed sides of the support tube socket 21 oriented between respective first and second positioning tubes 28 and 32. A pneumatic pump 39 is provided in pneumatic communication with the first and second pneumatic bladders 37 and 38 simultaneously through a pneumatic conduit 40 permitting pressurizing of the pneumatic bladders to position an individual's feet in a comfortable manner to accommodate variations and height on an individual's lap relative to various size chairs to afford comfort and convenience in use of the organization during a quilting procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A quilting hoop support apparatus, comprising, a base plate, the base plate including a top wall, wherein the top wall includes a support tube socket fixedly secured to the top wall, and the support tube socket having a first support tube received within the support tube socket in a coaxially aligned relationship, and a continuous inner hoop is provided concentric about a predetermined hoop axis, wherein the hoop axis is coaxially aligned with the first support tube and mounting means positioned within the first support tube for projection above the first support tube and arranged for pivotally mounting the inner hoop, and the mounting means includes a second support tube telescopically received within the first support tube, with the first support tube including a first support tube fastener directed through the first support tube in engagement with the second support tube, and the second support tube including a mounting tube, the mounting tube fixedly and orthogonally mounted to the second support tube, wherein the second support tube intersects the mounting tube medially thereof, and the mounting tube having a mounting tube first fastener and a mounting tube second fastener directed through the mounting tube on opposed sides of the second support tube, and a first L-shaped positioning tube received within the mounting tube and engaged by the mounting tube first fastener, and a second L-shaped positioning tube received within the mounting tube engaged by the mounting tube second fastener, and the first L-shaped positioning tube includes a first positioning tube first end portion within the mounting tube, and a first positioning tube second end portion orthogonally oriented relative to the first positioning tube first end portion, and the second positioning tube including a second positioning tube first end received within the mounting tube and engaged by the mounting tube second fastener, with a second positioning tube second end portion orthogonally oriented relative to the second positioning tube first end portion, and the inner hoop includes an inner hoop first flange and an inner hoop second flange, wherein the inner hoop first flange and the inner hoop second flange are arranged in a parallel coextensive relationship relative to one another and parallel to the inner hoop axis, and a discontinuous outer hoop oriented exteriorly of and concentric relative to the inner hoop, wherein the outer hoop includes an outer hoop first end and an outer hoop second end, the outer hoop first end including a first end flange, the outer hoop second end including a second end flange, and a hoop fastener directed through the first end flange and the second end flange to secure the first end flange to the second end flange, and the first positioning tube second end including a first axle directed therethrough and pivotally through the inner hoop first flange, and the second positioning tube second end including a second axle directed through the second positioning tube second end and pivotally directed through the inner hoop second flange, wherein the first axle and the second axle are coaxially aligned relative to one another permitting pivoting of the inner hoop between the first positioning tube and the second positioning tube.

2. An apparatus as set forth in claim 1 including a first pneumatic bladder and a second pneumatic bladder mounted to the base plate top wall on opposed sides of the support tube socket, and a pneumatic pump and a pneumatic conduit in pneumatic communication between the mounting pump in a first pneumatic bladder and the second pneumatic bladder to effect selective inflation of the first pneumatic bladder and the second pneumatic bladder.

* * * * *